US005558574A

United States Patent [19]

Peak

[11] Patent Number: 5,558,574

[45] Date of Patent: Sep. 24, 1996

[54] VENTILATOR

[75] Inventor: Richard A. Peak, Colchester, England

[73] Assignee: Titon Hardware Limited, Colchester, United Kingdom

[21] Appl. No.: 193,957

[22] Filed: Feb. 9, 1994

[30] Foreign Application Priority Data

Feb. 10, 1993 [GB] United Kingdom ..... 9302562

[51] Int. Cl.[6] ..... E06B 7/02

[52] U.S. Cl. ..... 454/213; 49/489.1; 454/274

[58] Field of Search ..... 454/211, 213, 454/222, 273, 274, 333, 334, 323; 49/405, 489.1

[56] References Cited

U.S. PATENT DOCUMENTS

| | | | |
|---|---|---|---|
| 1,016,392 | 2/1912 | Boudrot . | |
| 1,116,625 | 11/1914 | Pomerantz . | |
| 1,406,841 | 2/1922 | Foss . | |
| 1,436,649 | 11/1922 | Clark | 454/323 |
| 1,947,282 | 2/1934 | Theis | 292/347 |
| 2,151,231 | 3/1939 | Randall et al. | 49/489.1 |
| 3,068,045 | 12/1962 | Komenda | 49/489.1 |
| 3,094,058 | 6/1963 | O'Brien, Jr. et al. . | |
| 3,343,475 | 9/1967 | Costley . | |
| 4,510,715 | 4/1985 | Giguére | 49/489.1 |
| 4,702,157 | 10/1987 | Comparon . | |
| 4,727,797 | 3/1988 | Smith | 454/213 |
| 4,736,677 | 4/1988 | Smith | 454/213 |
| 5,244,434 | 9/1993 | Stoney et al. | 454/213 |
| 5,248,542 | 9/1993 | Hinzpeter et al. | 49/489.1 X |

FOREIGN PATENT DOCUMENTS

| | | | |
|---|---|---|---|
| 119045 | 3/1970 | Norway | 454/211 |
| 1417751 | 12/1975 | United Kingdom | 454/211 |
| 1582946 | 1/1981 | United Kingdom . | |
| 2241572 | 9/1991 | United Kingdom . | |

*Primary Examiner*—Harold Joyce
*Attorney, Agent, or Firm*—Price, Heneveld, Cooper, DeWitt & Litton

[57] ABSTRACT

A slot ventilator has first and second base portions which in use are secured to a facia, for example a window frame, one at each end of an elongate opening therein. An elongate body portion is secured to the base portions by respective first and second pivoting parallel motion links. The body has a handle whereby it may be moved between an open position, and a closed position in which the aperture is sealed by sealing flanges which extend out below the body.

19 Claims, 3 Drawing Sheets

VENTILATOR

BACKGROUND OF INVENTION

The present invention relates to a surface-mounted slot ventilator, for example for providing adjustable ventilation through a window frame.

SUMMARY OF INVENTION

According to the present invention there is provided a slot ventilator comprising first and second base portions adapted to be secured to a facia, one at each end of an elongate opening therein, and an elongate body portion secured to the base portions by respective first and second pivoting parallel-motion links, whereby when the base portions are so secured, the body is movable from an open position to a closed position in which sealing portions on the body press against the facia, on either side of the opening, thereby sealing the opening.

The invention also extends to a method of assembling a slot ventilator.

The invention may be carried into practice in a number of ways, and one specific embodiment will now be described, by way of example, with reference to the accompanying drawings, in which:

DETAILED DESCRIPTION OF THE PREFERRED EMBODIMENT

Figure 1:
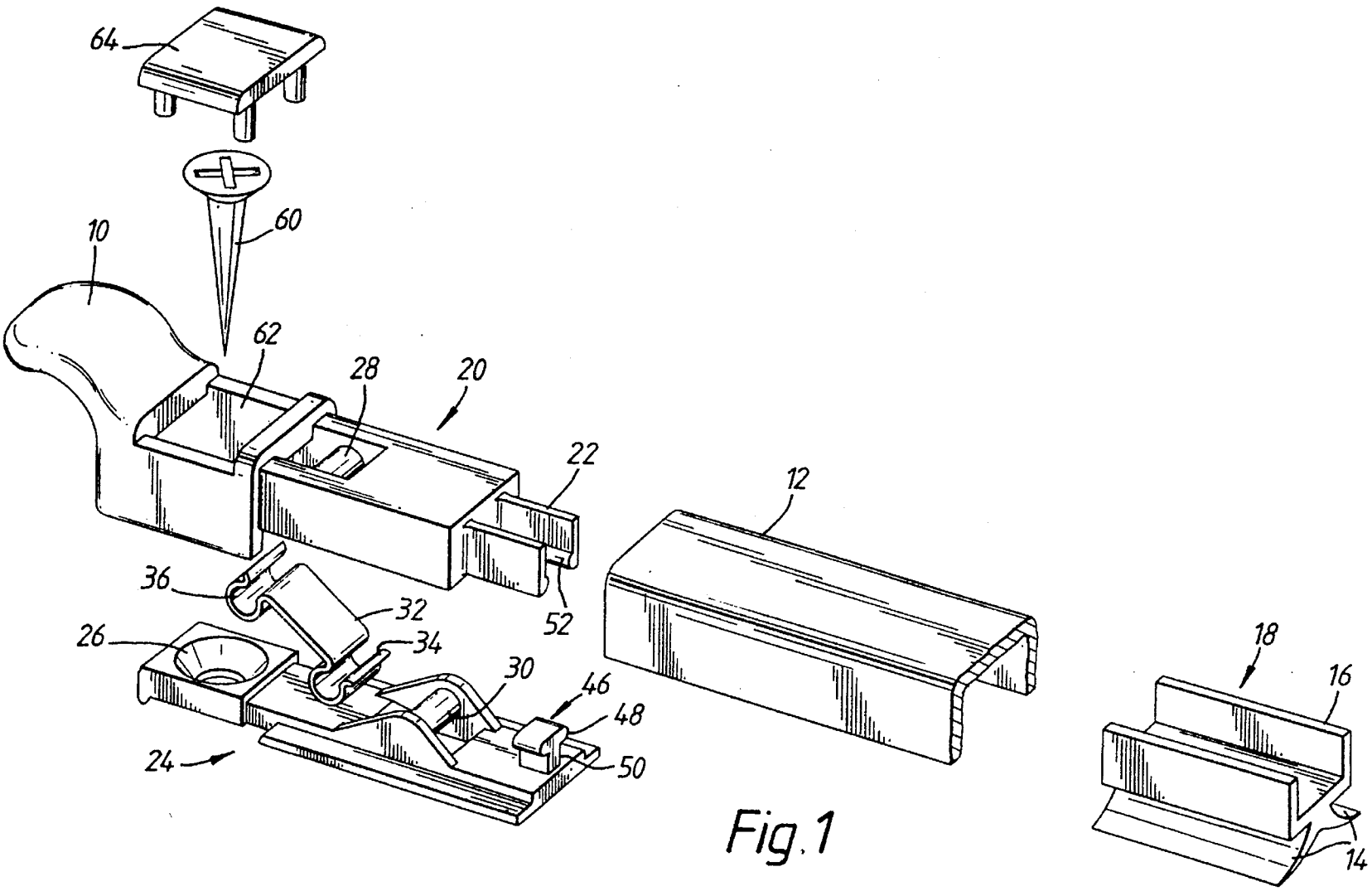
FIG. 1 is an exploded view of one end of the ventilator.

The overall features of the ventilator are best seen in the exploded drawing of FIG. 1. This shows one end of the ventilator, the other end being substantially identical, except that it need not have a manually graspable portion 10.

Figure 2A:
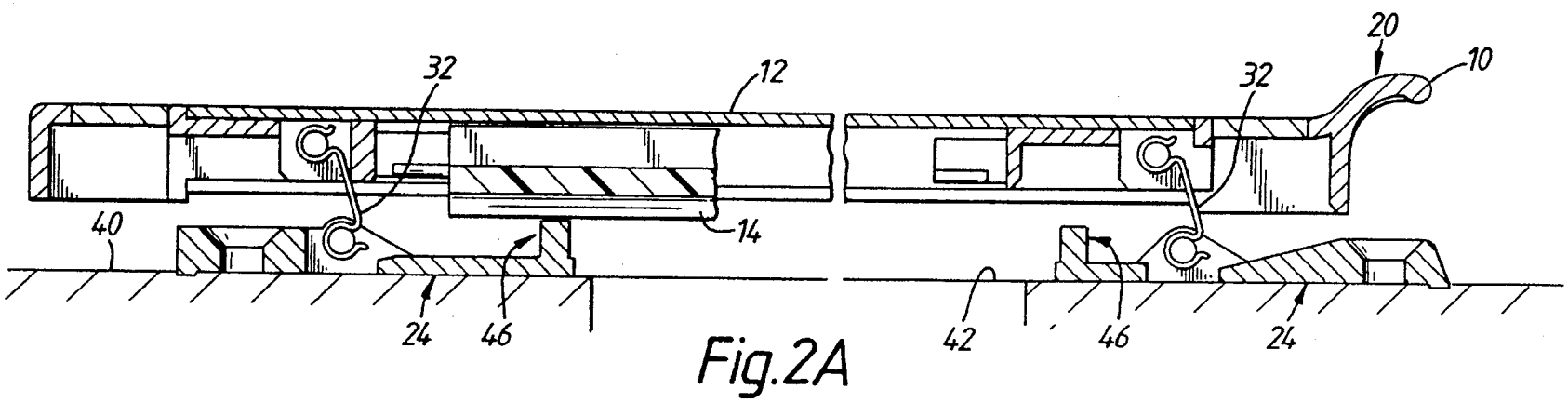
FIG. 2 is a longitudinal section through the ventilator in the open position.
FIG. 2B is a longitudinal section through the ventilator in the closed position.

The ventilator consists of an elongate aluminium or PVC extruded body 12, of generally inverted U shape in transverse section, the U-shape being defined by three orthogonally related flanges or wall sections. Located within the body, and extending along its length, is an upper mounting portion 16 of a PVC gasket 18. Extending downwardly below the mounting portion 16, and below the body 12, are two soft sealing flanges 14. The PVC gasket 18 may be extruded from a soft PVC material, or alternatively it may be dual hardness, with the sealing flanges being softer than the mounting portion. If the mounting portion 16 is rigid, or at least relatively so, it will give additional rigidity to the body 12, in the event that that is also moulded of a PVC material. At one end of the body 12 there is a moulded end cap 20, which is pushed/pressfit onto each end of the U-shaped extruded central body section and held in position by means of a pair of interference-fit or pressfit mounting guides 22 to form an assembly (FIGS. 1 and 2*a*). The end cap 20 has a manually graspable portion, or handle, 10 by which the ventilator may be operated.

Below the end cap is a moulded base plate, generally indicated at 24. The base plate incorporates a screw hole 26 by which it may be secured to a window frame or other substrate 40 (FIG. 2).

Both the end cap 20 and the base plate 24 are provided with transversely-extending pivot pins, respectively 28,30, and these two pivot pins are connected by a clip-on spring steel link 32. As will be evident from the drawing, the link 32 has at one end a clip portion 34 which snaps over the pivot pin 30, and at the other end a clip portion 36 which snaps over the pivot pin 28.

Figure 2B:
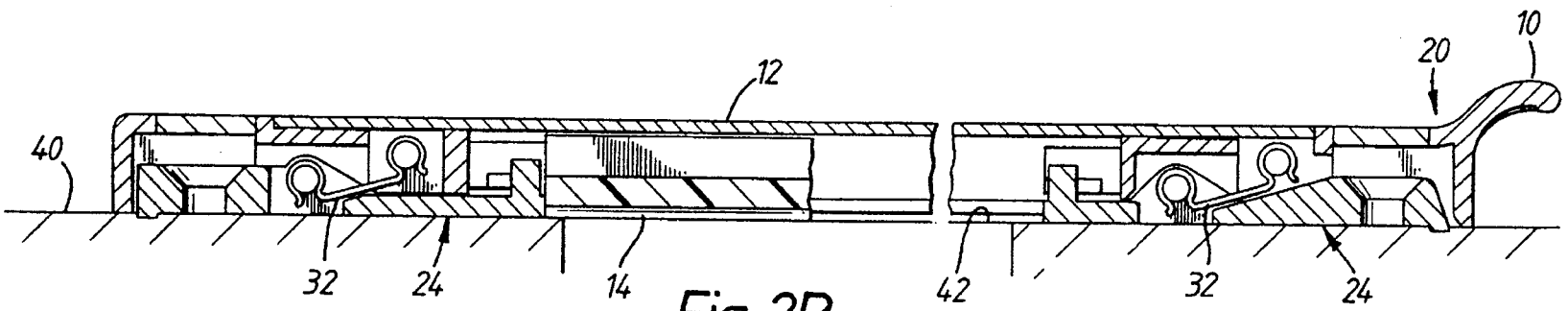

The operation of the ventilator is best seen with reference to FIGS. 2A and 2B. Since the ventilator is substantially identical at each end (except for the manually graspable portion 10, and the detailed shape of the end caps), the same reference numerals have been used to identify the same features at each end.

In use, the two base plates 24 are screwed into the surface of a window frame 40, at either end of a narrow ventilation slot 42 through the window.

When the handle 10 is grasped, the body can be moved between an open position, shown in FIG. 2A, and a closed position shown in FIG. 2B. Each of the spring links 32 rotate about their respective pivots, 28,30, so constraining the body 12 to remain parallel to the window frame 40 at all times. The pair of links 32 may accordingly conveniently be known as parallel motion links.

As the body is moved from the open to the closed position, the sealing flanges 14 of the gasket 18 contact and seal against those portions of the window frame (not shown) on either side of the slot 42. Thus, in the closed position, the opening of the slot 42 lies entirely between and is closed by the sealing flanges 14. As shown in FIG. 2B, as body 12 is moved to the closed position, it aesthetically covers and extends partially mateably around the base plates 24.

Figure 3A:
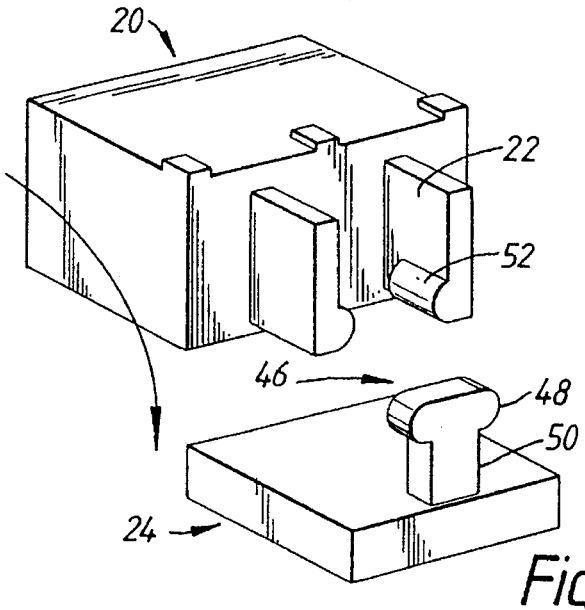
FIG. 3A to 3C shows the operation of the clip.
Figure 3B:
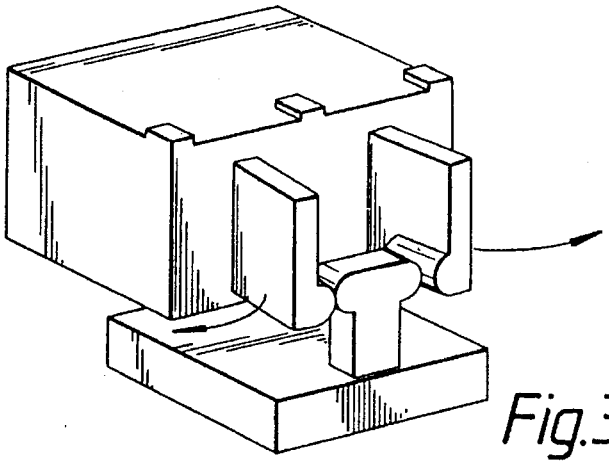
Figure 3C:
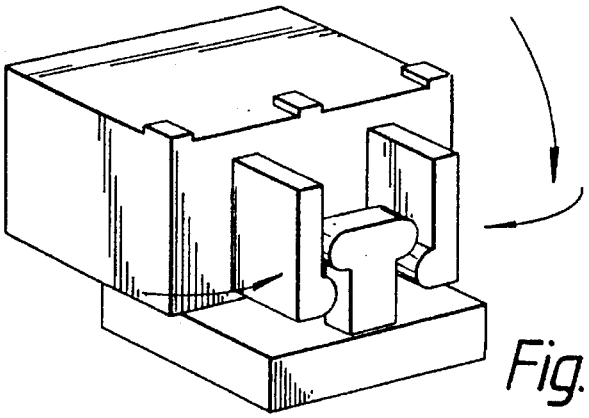

A positive clip mechanism is provided to retain the ventilator in the closed position. One part of the clip consists of a boss 46, moulded integrally with each of the base plates 24, and consisting of an enlarged head 48 on a narrower stalk 50. As the ventilator body moves to the closed position, the head 48 moves between the parallel mounting guides 22 on the end cap 20. Elongate beads 52 at the bottom of the mounting guides 22, provide for positive latching of the ventilator in the closed position. The operation of the clip as the ventilator moves towards the closed position is clearly shown in the sequence of drawings making up FIG. 3. In the latched position, the beads 52 are biased upwardly against the lower edges of the head 48 by the resilience of the sealing flanges 14, which in that position are of course pressed against the window frame 40.

Before being secured in position, the ventilator will have been partially pre-assembled, by sliding the co-extruded PVC gasket 18 into the body 12. On site, one of the base plates is then screwed into the window frame, in the desired position at one end of the slot 42, and this is then secured to the corresponding end cap 20 by means of the clip-on link 32. The end cap 20 is then slid into the end of the body 12. At the other end of the ventilator, a base plate, clip and end cap are similarly assembled, but without the base plate being screwed into the window frame. The ventilator is then manually closed, and the second base plate is then firmly screwed into position by means of a screw 60, which passes through an aperture 62 in the corresponding end cap. This method of assembly ensures that the base plates 24 are at their optimal distance apart. Once the second base plate has been screwed into position, the screw 60 is hidden behind a clip-on screw cover 64.

In the preferred embodiment, the pivot pins 28,30 are desirably integrally moulded with the end cap 20 and the base plate 24, respectively, but for greater strength it would also be possible to provide separate pivot pins, for example of metal. It would also be possible for the spring links 32 to be of a plastics material, rather than metal.

I claim:

1. A slot ventilator comprising first and second base portions adapted to be secured to a facia, one at each end of an elongate opening therein, and an elongate body portion secured to the base portions by respective first and second pivoting parallel motion links, whereby when the base portions are so secured, the body portion is movable from an open position to a closed position in which sealing portions on the body portion press against the facia, on either side of the opening, thereby sealing the opening;

the body portion being secured to each respective base portion by the first and second links, each of which is at one end arranged to pivot about a base pivot pin on the base portion, and at the other is arranged to pivot about a body pivot pin on the body, each of the first and second links being snap fit onto one or both of its respective pivot pins; and the body portion including first and second end caps which are pressfit into an extruded central body section.

2. A ventilator as claimed in claim 1, in which each link comprises a spring steel member configured to snap-fit onto one or both of its respective pivot pins.

3. A ventilator as claimed in claim 1, in which said elongate body portion includes orthogonal flanges, separate from the sealing portions, that extend at least partially mateably around said base portions when in the closed position.

4. A ventilator as claimed in claim 1, in which the sealing portions comprise two sealing flanges of a sealing gasket, the gasket including a mounting portion extending along the length of and located within the body, the sealing flanges depending from the mounting portion and extending along the length of the body, the flanges being adapted to press against the facia to which the base portions are secured to seal the opening in the closed position of the body.

5. A ventilator as claimed in claim 1, in which the sealing portions comprise a soft material.

6. A slot ventilator comprising:

first and second base portions adapted to be secured to a facia, one at each end of an elongate opening therein, and an elongate body portion secured to the base portions by respective first and second pivoting parallel motion links, whereby when the base portions are so secured, the body portion is movable from an open position to a closed position in which sealing portions on the body portion press against the facia, on either side of the opening, thereby sealing the opening; and latch means operably connected to said body portion and at least one of said first and second base portions for releasably holding the ventilator in the closed position, said latch means including a boss and at least one shoulder for releasably engaging the boss.

7. A slot ventilator comprising first and second base portions adapted to be secured to a facia, one at each end of an elongate opening therein, and an elongate body portion secured to the base portions by respective first and second pivoting parallel motion links, whereby when the base portions are so secured, the body portion is movable from an open position to a closed position in which sealing portions on the body portion press against the facia, on either side of the opening, thereby sealing the opening; and latch means for releasably holding the ventilator in the closed position, the latch means comprising a boss on one of the body portion and a corresponding of said first and second base portions, the boss having an enlarged head which in the closed position is retained behind opposing shoulders on the other of the body portion and said corresponding base portion.

8. A ventilator as claimed in claim 7 in which the body portion covers the base portions when the ventilator is in the closed position.

9. A ventilator as claimed in claim 8, in which the body portion has an aperture whereby at least one of said base portions may be secured in position to the facia when the ventilator is in the closed position.

10. A ventilator as claimed in claim 9, in which each base portion is adapted to be secured to the facia by a screw which, during securing, passes through each aperture in the body portion.

11. A ventilator as claimed in claim 10 further including a cover for each aperture which is assembled to the base to hide the screw once the ventilator is secured in position.

12. A slot ventilator comprising first and second base portions adapted to be secured to a facia, one at each end of an elongate opening therein, and an elongate body portion secured to the base portions by respective first and second pivoting parallel motion links, whereby when the base portions are so secured, the body portion is movable from an open position to a closed position in which sealing portions on the body portion press against the facia, on either side of the opening, thereby sealing the opening; and the body portion including an extruded central body section and first and second end caps which are pressfit into the extruded central body section.

13. A ventilator as claimed in claim 12, in which each end cap includes a respective body pivot pin.

14. A slot ventilator comprising first and second base portions adapted to be secured to a facia, one at each end of an elongate opening therein, and an elongate body portion secured to the base portions by respective first and second pivoting parallel motion links, whereby when the base portions are so secured, the body portion is movable from an open position to a closed position in which sealing portions on the body portion press against the facia, on either side of the opening, thereby sealing the opening; and a latch for holding the body portion against the base portions in the closed position, said latch including a boss on one of the body portion and a corresponding of said first and second base portions, and a mating member on the other of the body portion and the corresponding base portion, said mating member being configured to frictionally engage the boss when in the closed position.

15. A ventilator as claimed in claim 14, in which the body portion covers the base portions when the ventilator is in the closed position.

16. A slot ventilator comprising first and second base portions adapted to be secured to a facia, one at each end of an elongate opening therein, and an elongate body portion secured to the base portions by respective first and second pivoting parallel-motion links, the body portion including end caps which are pressfit into an extruded central body section of the body portion, the links of each parallel motion link being pivoted at each end about a base pivot pin on the base portion and a body pivot pin on the end cap of the body portion, each body pivot pin being located inside the central body section once the end caps have been fitted therein, whereby, when the base portions are secured to the facia, the body portion is movable from an open position to a closed position in which sealing portions on the body portion press against the facia, on either side of the opening, thereby sealing the opening.

17. A ventilator as claimed in claim 16, in which each end cap includes a respective separate pivot pin.

18. A ventilator as claimed in claim 16, in which the body portion is U-shaped and covers the base portions on more than one side when the ventilator is in the closed position.

19. A slot ventilator comprising:

first and second base portions adapted to be secured to a facia, one at each end of an elongate opening therein, and an elongate body portion secured to the base portions by respective first and second pivoting parallel-motion links, the body portion including end caps which are pressfit into an extruded central body section of the body portion, the links of each parallel motion link being pivoted at each end about a base pivot pin on the base portion and a body pivot pin on the end cap of the body portion, each body pivot pin being located inside the central body section once the end caps have been fitted therein, whereby, when the base portions are secured to the facia, the body portion is movable from an open position to a closed position in which sealing portions on the body portion press against the facia, on either side of the opening, thereby sealing the opening; and a latch for releasably holding the ventilator in the closed position, the latch comprising a boss on one of the body portion and a corresponding of said first and second base portions, the boss having an enlarged head which in the closed position is retained by opposing shoulders on the other of the body portion and the corresponding base portion.

* * * * *